US010167116B1

(12) United States Patent
Huang et al.

(10) Patent No.: US 10,167,116 B1
(45) Date of Patent: Jan. 1, 2019

(54) FLEXIBLE BAG WITH MICROCAPILLARY STRIP

(71) Applicant: Dow Global Technologies LLC, Midland, MI (US)

(72) Inventors: Wenyi Huang, Midland, MI (US); Hongming Ma, Freeport, TX (US); Laura J. Dietsche, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/693,042

(22) Filed: Aug. 31, 2017

(51) Int. Cl.
*B65D 33/01* (2006.01)
*B65D 75/30* (2006.01)

(52) U.S. Cl.
CPC ..... *B65D 33/01* (2013.01); *B65D 75/30* (2013.01)

(58) Field of Classification Search
CPC ..... B65D 33/01
USPC ..... 383/100–103
See application file for complete search history.

(56) References Cited

U.S. PATENT DOCUMENTS 3,042,287 A 7/1962 Chandler
3,085,608 A 4/1963 Mathues
3,092,249 A * 6/1963 Chapman ..... A61F 15/001 206/210
4,310,118 A * 1/1982 Kisida ..... B65D 33/01 383/102
4,743,123 A 5/1988 Ligters et al.
4,812,055 A * 3/1989 Prader ..... B65D 31/10 383/119
5,677,383 A 10/1997 Chum et al.
6,111,023 A 8/2000 Chum et al.
6,550,223 B2 4/2003 Xiong et al.
6,984,695 B2 1/2006 Brown et al.
7,137,738 B2 11/2006 Shah et al.
8,263,206 B2 9/2012 Kronawittleithner et al.
2003/0179960 A1 9/2003 Beaulieu
2005/0036718 A1 2/2005 Wu et al.
2008/0202075 A1 8/2008 Kronawittleithner et al.
(Continued)

FOREIGN PATENT DOCUMENTS

EP 0700839 A1 3/1996
WO 2004/106392 A1 12/2004
(Continued)

OTHER PUBLICATIONS

T. Scholte et al., J. Appl. Polymn. Sci., vol. 29, pp. 3763-3782, 1984.
(Continued)

*Primary Examiner* — Jes F Pascua
*Assistant Examiner* — Nina Attel
(74) *Attorney, Agent, or Firm* — Husch Blackwell LLP

(57) ABSTRACT

In an embodiment, a flexible bag is provided and includes opposing flexible films composed of a polymeric material. The flexible films define a common peripheral edge. The flexible bag includes a microcapillary strip located between the opposing flexible films and extending along a portion of the common peripheral edge. A peripheral seal extends along at least a portion of the common peripheral edge. The peripheral seal seals the microcapillary strip between the opposing flexible films. The peripheral seal forms a closed compartment. The flexible bag includes an amount of a flowable solid particulate material (FSPM) in the storage compartment.

19 Claims, 6 Drawing Sheets

(56) References Cited

U.S. PATENT DOCUMENTS

| | | | | |
|---|---|---|---|---|
| 2008/0273820 | A1 | 11/2008 | Wiker et al. | |
| 2009/0011182 | A1 | 1/2009 | Mackley et al. | |
| 2009/0260326 | A1 | 10/2009 | Grimm et al. | |
| 2011/0020574 | A1 | 1/2011 | Mackley et al. | |
| 2011/0049038 | A1 | 3/2011 | Aerts et al. | |
| 2013/0287323 | A1* | 10/2013 | Slovut | B65D 71/08 383/84 |
| 2013/0288016 | A1 | 10/2013 | Koopmans et al. | |
| 2014/0072776 | A1 | 3/2014 | Zalamea et al. | |
| 2014/0113112 | A1 | 4/2014 | Koopmans et al. | |
| 2015/0321407 | A1 | 11/2015 | Dooley et al. | |
| 2015/0321409 | A1 | 11/2015 | Dooley et al. | |
| 2017/0087759 | A1 | 3/2017 | Huang et al. | |

FOREIGN PATENT DOCUMENTS

| | | | |
|---|---|---|---|
| WO | 2015/057053 | A1 | 4/2015 |
| WO | 2017/003859 | A1 | 1/2017 |

OTHER PUBLICATIONS

E. Otocka et al., Macromolecules, vol. 4, No. 4, pp. 507-514, Jul.-Aug. 1971.

* cited by examiner

FLEXIBLE BAG WITH MICROCAPILLARY STRIP

BACKGROUND

The packaging of flowable solid particulate material (FSPM) represents a challenge when using the air-impermeable plastic bags. When filling and sealing the bag with FSPM (such as flour or cement powder, for example), a substantial amount air may be entrained within the bag interior. If this residual air is not released by a valve or perforation of the bag, the volume of the bag is unnecessarily large—making storage, stacking, transport, and handling of the FSPM bag difficult. The residual air within an FSPM-filled bag also compromises the stability of bags stacked upon each other, such as on pallets, for example. The presence of residual air in the FSPM-filled bag also reduces the number of bags that can be transported on a forklift, for example.

Perforation of the film results in water penetration for outdoor storage and deterioration of film physical properties. These pose great challenges for paper to plastics conversion for powdery goods.

Conventional attempts to remove residual air form FSPM-filled bags have shortcomings. Vacuum sealing FSPM-filled bags is disadvantageous because this process invokes a high capital cost for vacuum equipment which is compounded by constant maintenance costs to keep the vacuum equipment operational. For example, the filters of the vacuum sealing device require constant cleaning to avoid damage to the vacuum sealing device.

The use of perforated plastic films for the bag fail to adequately protect the FSPM from water penetration. Perforated plastic films are particularly problematic in outdoor storage environments where exposure to rain, humidity and other ambient moisture enters the perforations and degrades the FSPM content. Water penetration yields to agglomeration, degradation, decay, and deterioration of the flowable solid particulate material.

Consequently, the art recognizes the need for improved packaging systems for the filling and storage of flowable solid particulate material.

SUMMARY

The present disclosure is directed to a flexible bag with a microcapillary strip that enables air venting (by mechanical pressure for example rolling or compacting).

In an embodiment, a flexible bag is provided and includes opposing flexible films composed of a polymeric material. The flexible films define a common peripheral edge. The flexible bag includes a microcapillary strip located between the opposing flexible films and extending along a portion of the common peripheral edge. A peripheral seal extends along at least a portion of the common peripheral edge. The peripheral seal seals the microcapillary strip between the opposing flexible films. The peripheral seal forms a closed compartment. The flexible bag includes an amount of a flowable solid particulate material (FSPM) in the storage compartment.

An advantage of the present disclosure is the provision of the microcapillary strip into the flexible bag yielding an economical (low cost) and reliable system for the removal of residual air and the prevention of external moisture into the flexible bag.

An advantage of the present disclosure is heavy duty flexible bag for the storage of bulk FSPM, the heavy duty flexible bag providing protection, impact resistance and reliable degassing for the filled bag.

DEFINITIONS

Figure 1:
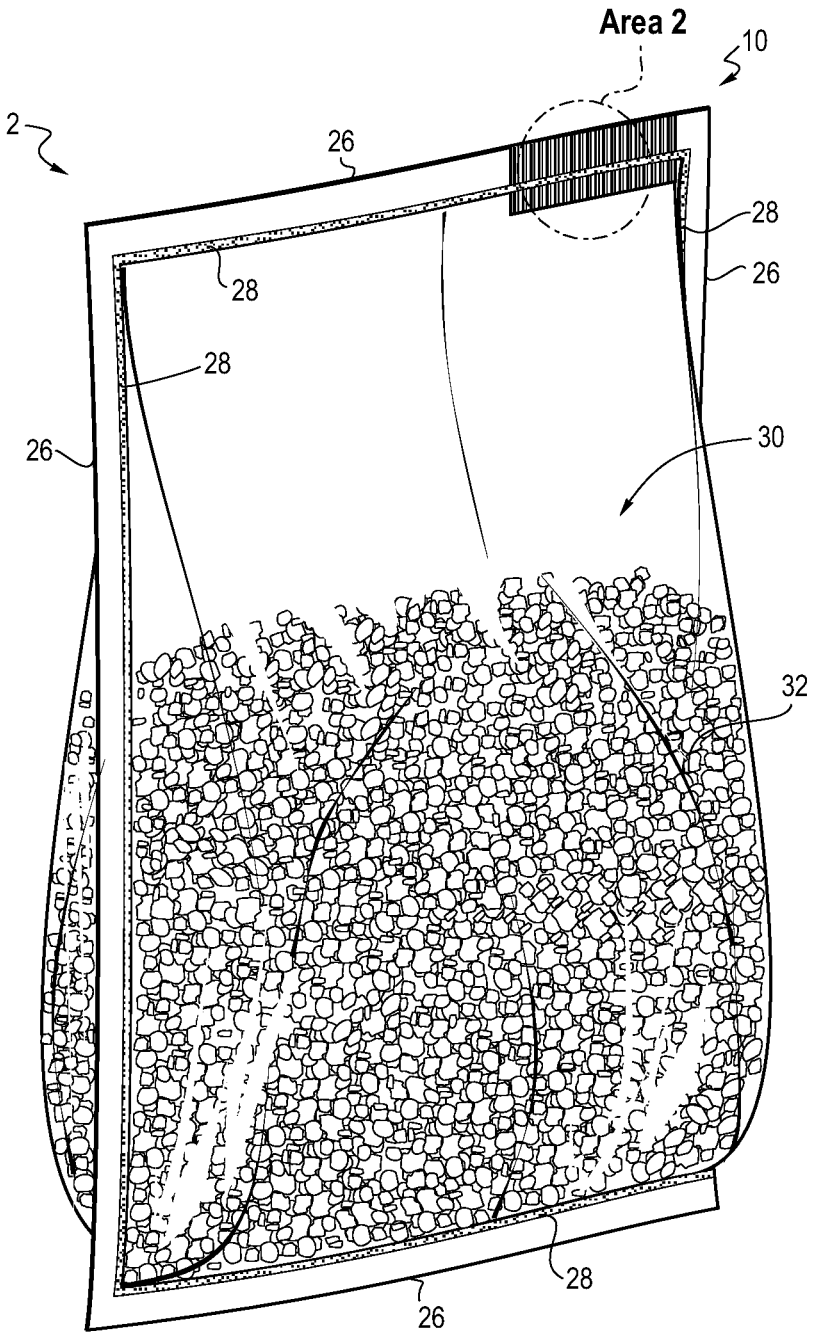
FIG. 1 is a perspective view of a flexible bag in accordance with an embodiment of the present disclosure.

Any reference to the Periodic Table of Elements is that as published by CRC Press, Inc., 1990-1991. Reference to a group of elements in this table is by the new notation for numbering groups.

For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges disclosed herein include all values from, and including, the lower and upper value. For ranges containing explicit values (e.g., 1 or 2, or 3 to 5, or 6, or 7), any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight and all test methods are current as of the filing date of this disclosure.

The terms "blend" or "polymer blend," as used herein, is a blend of two or more polymers. Such a blend may or may not be miscible (not phase separated at molecular level). Such a blend may or may not be phase separated. Such a blend may or may not contain one or more domain configurations, as determined from transmission electron spectroscopy, light scattering, x-ray scattering, and other methods known in the art.

The term "composition" refers to a mixture of materials which comprise the composition, as well as reaction products and decomposition products formed from the materials of the composition.

The terms "comprising," "including," "having" and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term "consisting essentially of" excludes from the scope of any succeeding recitation any other component, step, or procedure, excepting those that are not essential to operability. The term "consisting of" excludes any component, step, or procedure not specifically delineated or listed. The term "or," unless stated otherwise, refers to the listed members individually as well as in any combination. Use of the singular includes use of the plural and vice versa.

An "ethylene-based polymer" is a polymer that contains more than 50 weight percent (wt %) polymerized ethylene monomer (based on the total amount of polymerizable monomers) and, optionally, may contain at least one comonomer. Ethylene-based polymer includes ethylene homopolymer, and ethylene copolymer (meaning units derived from ethylene and one or more comonomers). The terms "ethylene-based polymer" and "polyethylene" may be used interchangeably. Nonlimiting examples of ethylene-based polymer (polyethylene) include low density polyethylene (LDPE) and linear polyethylene. Nonlimiting examples of linear polyethylene include linear low density polyethylene (LLDPE), ultra low density polyethylene (ULDPE), very low density polyethylene (VLDPE), multi-component ethylene-based copolymer (EPE), ethylene/α-olefin multi-block copolymers (also known as olefin block copolymer (OBC)), single-site catalyzed linear low density polyethylene (m-LLDPE), substantially linear, or linear, plastomers/elastomers, and high density polyethylene (HDPE). Generally, polyethylene may be produced in gas-phase, fluidized bed reactors, liquid phase slurry process reactors, or liquid phase solution process reactors, using a heterogeneous catalyst system, such as Ziegler-Natta catalyst, a homogeneous catalyst system, comprising Group 4 transition metals and ligand structures such as metallocene, non-metallocene metal-centered, heteroaryl, heterovalent aryloxyether, phosphinimine, and others. Combinations of heterogeneous and/or homogeneous catalysts also may be used in either single reactor or dual reactor configurations.

"High density polyethylene" (or "HDPE") is an ethylene homopolymer or an ethylene/α-olefin copolymer with at least one $C_4$-$C_{10}$ α-olefin comonomer, or $C_4$-$C_8$ α-olefin comonomer and a density from 0.940 g/cc, or 0.945 g/cc, or 0.950 g/cc, 0.953 g/cc to 0.955 g/cc, or 0.960 g/cc, or 0.965 g/cc, or 0.970 g/cc, or 0.975 g/cc, or 0.980 g/cc. The HDPE can be a monomodal copolymer or a multimodal copolymer. A "monomodal ethylene copolymer" is an ethylene/$C_4$-$C_{10}$ α-olefin copolymer that has one distinct peak in a gel permeation chromatography (GPC) showing the molecular weight distribution. A "multimodal ethylene copolymer" is an ethylene/$C_4$-$C_{10}$ α-olefin copolymer that has at least two distinct peaks in a GPC showing the molecular weight distribution. Multimodal includes copolymer having two peaks (bimodal) as well as copolymer having more than two peaks. Nonlimiting examples of HDPE include DOW™ High Density Polyethylene (HDPE) Resins (available from The Dow Chemical Company), ELITE™ Enhanced Polyethylene Resins (available from The Dow Chemical Company), CONTINUUM™ Bimodal Polyethylene Resins (available from The Dow Chemical Company), LUPOLEN™ (available from LyondellBasell), as well as HDPE products from Borealis, Ineos, and ExxonMobil.

An "interpolymer" is a polymer prepared by the polymerization of at least two different monomers. This generic term includes copolymers, usually employed to refer to polymers prepared from two different monomers, and polymers prepared from more than two different monomers, e.g., terpolymers, tetrapolymers, etc.

"Low density polyethylene" (or "LDPE") consists of ethylene homopolymer, or ethylene/α-olefin copolymer comprising at least one $C_3$-$C_{10}$ α-olefin that has a density from 0.915 g/cc to less than 0.940 g/cc and contains long chain branching with broad MWD. LDPE is typically produced by way of high pressure free radical polymerization (tubular reactor or autoclave with free radical initiator). Nonlimiting examples of LDPE include MarFlex™ (Chevron Phillips), LUPOLEN™ (LyondellBasell), as well as LDPE products from The Dow Chemical Company, Borealis, Ineos, ExxonMobil, and others.

"Linear low density polyethylene" (or "LLDPE") is a linear ethylene/α-olefin copolymer containing heterogeneous short-chain branching distribution comprising units derived from ethylene and units derived from at least one $C_3$-$C_{10}$ α-olefin comonomer. LLDPE is characterized by little, if any, long chain branching, in contrast to conventional LDPE. LLDPE has a density from 0.910 g/cc to less than 0.940 g/cc. Nonlimiting examples of LLDPE include TUFLIN™ linear low density polyethylene resins (available from The Dow Chemical Company), DOWLEX™ polyethylene resins (available from the Dow Chemical Company), and MARLEX™ polyethylene (available from Chevron Phillips).

"Multi-component ethylene-based copolymer" (or "EPE") comprises units derived from ethylene and units derived from at least one $C_3$-$C_{10}$ α-olefin comonomer, such as described in patent references U.S. Pat. No. 6,111,023; U.S. Pat. No. 5,677,383; and U.S. Pat. No. 6,984,695. EPE resins have a density from 0.905 g/cc to 0.962 g/cc. Nonlimiting examples of EPE resins include ELITE™ enhanced polyethylene (available from The Dow Chemical Company), ELITE AT™ advanced technology resins (available from The Dow Chemical Company), SURPASS™ Polyethylene (PE) Resins (available from Nova Chemicals), and SMART™ (available from SK Chemicals Co.).

An "olefin-based polymer" or "polyolefin" is a polymer that contains more than 50 weight percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 weight percent polymerized propylene monomer (based on the total amount of polymerizable monomers) and, optionally, may contain at least one comonomer. Propylene-based polymer includes propylene homopolymer, and propylene copolymer (meaning units derived from propylene and one or more comonomers). The terms "propylene-based polymer" and "polypropylene" may be used interchangeably.

"Single-site catalyzed linear low density polyethylenes" (or "m-LLDPE") are linear ethylene/α-olefin copolymers containing homogeneous short-chain branching distribution comprising units derived from ethylene and units derived from at least one $C_3$-$C_{10}$ α-olefin comonomer. m-LLDPE has density from 0.913 g/cc to less than 0.940 g/cc. Nonlimiting examples of m-LLDPE include EXCEED™ metallocene PE (available from ExxonMobil Chemical), LUFLEXEN™ m-LLDPE (available from LyondellBasell), and ELTEX™ PF m-LLDPE (available from Ineos Olefins & Polymers).

"Ultra low density polyethylene" (or "ULDPE") and "very low density polyethylene" (or "VLDPE") each is a linear ethylene/α-olefin copolymer containing heterogeneous short-chain branching distribution comprising units derived from ethylene and units derived from at least one $C_3$-$C_{10}$ α-olefin comonomer. ULDPE and VLDPE each has a density from 0.885 g/cc to 0.915 g/cc. Nonlimiting examples of ULDPE and VLDPE include ATTANE™ ultra low density polyethylene resins (available from The Dow Chemical Company) and FLEXOMER™ very low density polyethylene resins (available from The Dow Chemical Company).

TEST METHODS

Density is measured in accordance with ASTM D792. The result is recorded in grams per cubic centimeter (g/cc).

Melt flow rate (MFR) is measured according to ASTM D1238 (230° C./2.16 kg). The result is reported in grams eluted per 10 minutes (g/10 min).

Melt index (MI) (I2) in g/10 min is measured using ASTM D1238 (190° C./2.16 kg). Melt index (MI) (I10) in g/10 min is measured using ASTM D1238 (190° C./10 kg).

Differential Scanning Calorimetry (DSC)

Differential Scanning Calorimetry (DSC) can be used to measure the melting, crystallization, and glass transition behavior of a polymer over a wide range of temperature. For example, the TA Instruments Q1000 DSC, equipped with an RCS (refrigerated cooling system) and an autosampler is used to perform this analysis. During testing, a nitrogen purge gas flow of 50 ml/min is used. Each sample is melt pressed into a thin film at about 175° C.; the melted sample is then air-cooled to room temperature (about 25° C.). A 3-10 mg, 6 mm diameter specimen is extracted from the cooled polymer, weighed, placed in a light aluminum pan (ca 50 mg), and crimped shut. Analysis is then performed to determine its thermal properties.

The thermal behavior of the sample is determined by ramping the sample temperature up and down to create a heat flow versus temperature profile. First, the sample is rapidly heated to 180° C. and held isothermal for 3 minutes in order to remove its thermal history. Next, the sample is cooled to −40° C. at a 10° C./minute cooling rate and held isothermal at −40° C. for 3 minutes. The sample is then heated to 180° C. (this is the "second heat" ramp) at a 10° C./minute heating rate. The cooling and second heating curves are recorded. The cool curve is analyzed by setting baseline endpoints from the beginning of crystallization to −20° C. The heat curve is analyzed by setting baseline endpoints from −20° C. to the end of melt. The values determined are extrapolated onset of melting, Tm, and extrapolated onset of crystallization, Tc. Heat of fusion ($H_f$) (in Joules per gram), and the calculated % crystallinity for polyethylene samples using the following Equation: % Crystallinity=(($H_f$)/292 J/g)×100

The heat of fusion ($H_f$) (also known as melt enthalpy) and the peak melting temperature are reported from the second heat curve. Peak crystallization temperature is determined from the cooling curve.

Melting point, Tm, is determined from the DSC heating curve by first drawing the baseline between the start and end of the melting transition. A tangent line is then drawn to the data on the low temperature side of the melting peak. Where this line intersects the baseline is the extrapolated onset of melting (Tm). This is as described in Bernhard Wunderlich, *The Basis of Thermal Analysis, in Thermal Characterization of Polymeric Materials* 92, 277-278 (Edith A. Turi ed., 2d ed. 1997).

Crystallization temperature, Tc, is determined from a DSC cooling curve as above except the tangent line is drawn on the high temperature side of the crystallization peak. Where this tangent intersects the baseline is the extrapolated onset of crystallization (Tc).

Gel Permeation Chromatography (GPC)

A high temperature gel permeation chromatography (GPC) system, equipped with Robotic Assistant Deliver (RAD) system is used for sample preparation and sample injection. The concentration detector is an Infra-red detector (IR-5) from Polymer Char Inc. (Valencia, Spain). Data collection is performed using a Polymer Char DM 100 Data acquisition box. The carrier solvent is 1,2,4-trichlorobenzene (TCB). The system is equipped with an on-line solvent degas device from Agilent. The column compartment is operated at 150° C. The columns are four Mixed A LS 30 cm, 20 micron columns. The solvent is nitrogen-purged 1,2,4-trichlorobenzene (TCB) containing approximately 200 ppm 2,6-di-t-butyl-4-methylphenol (BHT). The flow rate is 1.0 mL/min, and the injection volume is 200 μl. A "2 mg/mL" sample concentration is prepared by dissolving the sample in $N_2$ purged and preheated TCB (containing 200 ppm BHT), for 2.5 hours at 160° C., with gentle agitation.

The GPC column set is calibrated by running twenty narrow molecular weight distribution polystyrene standards. The molecular weight (MW) of the standards ranges from 580 g/mol to 8,400,000 g/mol, and the standards are contained in six "cocktail" mixtures. Each standard mixture has at least a decade of separation between individual molecular weights. The equivalent polypropylene molecular weights of each PS standard are calculated by using following equation, with reported Mark-Houwink coefficients for polypropylene (Th. G. Scholte, N. L. J. Meijerink, H. M. Schoffeleers, & A. M. G. Brands, J. Appl. Polym. Sci., 29, 3763-3782 (1984)) and polystyrene (E. P. Otocka, R. J. Roe, N. Y. Hellman, & P. M. Muglia, Macromolecules, 4, 507 (1971)):

$$M_{PP} = \left(\frac{K_{PS} M_{PS}^{a_{PS}+1}}{K_{PP}}\right)^{\frac{1}{a_{PP}+1}}, \quad \text{(Eq 1)}$$

where $M_{pp}$ is PP equivalent MW, $M_{PS}$ is PS equivalent MW, log K and α values of Mark-Houwink coefficients for PP and PS are listed below.

| Polymer | α | log K |
|---|---|---|
| Polypropylene | 0.725 | −3.721 |
| Polystyrene | 0.702 | −3.900 |

A logarithmic molecular weight calibration is generated using a fourth order polynomial fit as a function of elution volume. Number average and weight average molecular weights are calculated according to the following equations:

$$M_n = \frac{\sum_i^i Wf_i}{\sum_i^i (Wf_i / M_i)}, \quad \text{(Eq 2)}$$

$$M_w = \frac{\sum_i^i (Wf_i * M_i)}{\sum_i^i (Wf_i)}, \quad \text{(Eq 3)}$$

where $Wf_i$ and $M_i$ are the weight fraction and molecular weight of elution component i, respectively.

DETAILED DESCRIPTION

The present disclosure provides a flexible bag. The flexible bag includes opposing flexible films, each flexible film composed of a polymeric material. The opposing flexible films define a common peripheral edge. A microcapillary strip is located between the opposing flexible films. A peripheral seal extends along at least a portion of the common peripheral edge. The peripheral seal seals the microcapillary strip between the opposing flexible films. The peripheral seal forms a closed compartment. An amount of a flowable solid particulate material is present in the closed compartment.

In an embodiment, FIG. 1 shows a flexible bag 2. The flexible bag 2 includes a microcapillary strip 10, a flexible film 22, a flexible film 24, and an amount of a flowable solid particulate material 32. The components, features, and interrelationships between each of these elements is described in detail below.

1. Microcapillary Strip

The present flexible bag includes a microcapillary strip. The microcapillary strip can be sealed at any location on the flexible bag. The microcapillary strip can be sealed to a face of the flexible bag. The microcapillary strip can be positioned between the sealing films, where the seal is not at the peripheral edges on the surface of the bag. The microcapillary strip can be sealed along a fin seal and/or along a lap seal that extends along the center of the flexible bag, for example.

Figure 2:
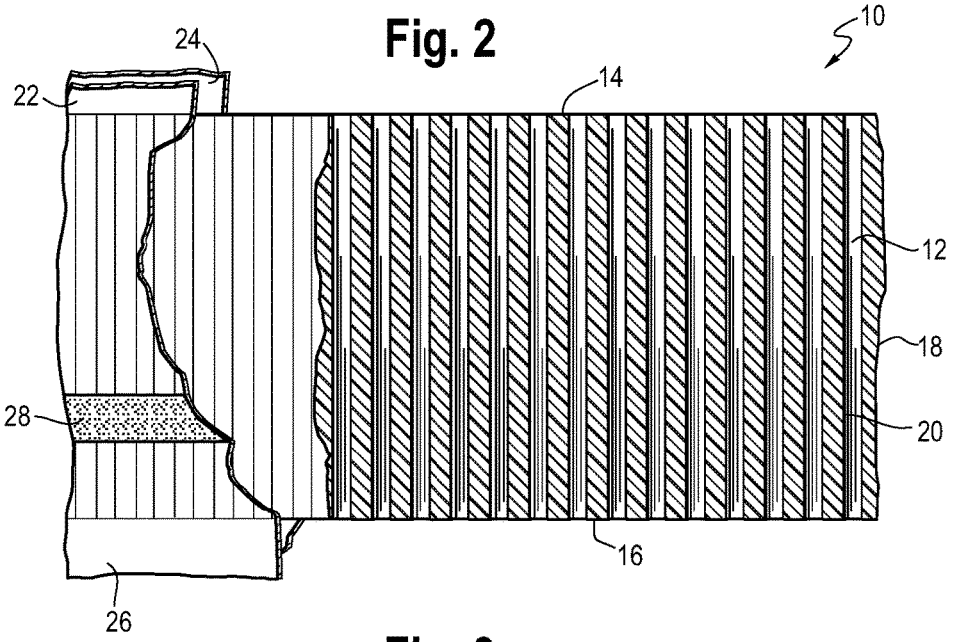
FIG. 2 is an enlarged cutaway plan view of Area 2 of FIG. 1 showing the flexible films and the microcapillary strip of the flexible bag.
Figure 3:
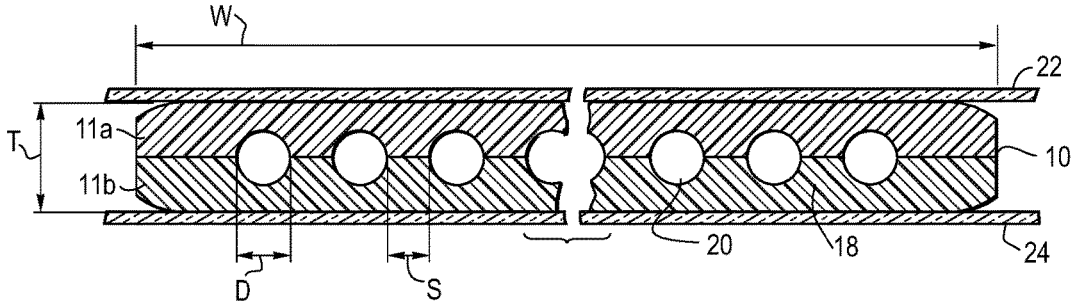
FIG. 3 is an elevational view of the flexible films and the microcapillary strip of FIG. 2.
Figure 3A:
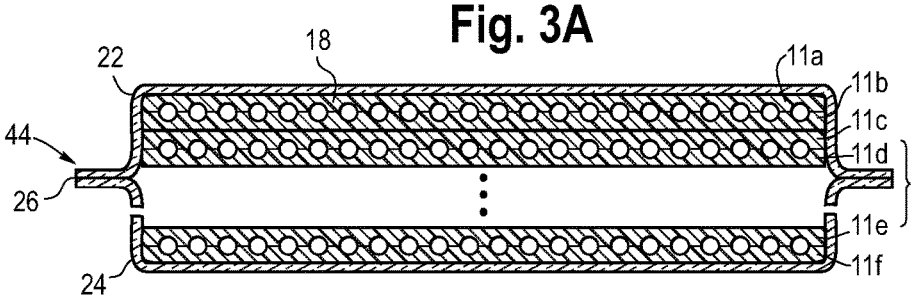
FIG. 3A is an elevational view of the flexible films and a multilayer microcapillary strip in accordance with another embodiment of the present disclosure.

In an embodiment, FIGS. 1, 2, 3 and 3A show a microcapillary strip 10 that is sealed between the opposing flexible films 22, 24 (as will be described in detail below). FIGS. 1-3A depict various views of a microcapillary strip 10 (or strip 10). The microcapillary strip 10 is composed of multiple layers (11*a*, 11*b*) of a polymeric material. While only two layers (11*a*, 11*b*) are depicted in FIG. 3, the microcapillary strip 10 may include one, or three, or four, or five, or six, or more layers 11*a*-11*f*, as shown in FIG. 3A.

As shown in FIGS. 2 and 3, the microcapillary strip 10 has void volumes 12 and a first end 14 and a second end 16. The microcapillary strip 10 is composed of a matrix 18, which is a polymeric material. The matrix 18 may comprise reciprocal layers (such as layers 11*a*, 11*b*). Alternatively, matrix 18 may be an integral and uniform polymeric material.

One or more channels 20 are disposed in the matrix 18. The channels 20 are arranged alongside and extend from the first end 14 to the second end 16 of the microcapillary strip 10. The channels 20 are positioned between the layers 11*a*, 11*b*. The number of channels 20 may be varied as desired. Each channel 20 has a cross-sectional shape. Nonlimiting examples of suitable cross-sectional shapes for the channels include oval, ovoid, circle, curvilinear, triangle, square, rectangle, star, diamond, and combinations thereof.

The channels 20 have a diameter, D, as shown in FIG. 3. The term "diameter," as used herein, is the longest axis of the channel 20, from a cross-sectional view. In an embodiment, the diameter, D, is from 50 micrometer (μm), or 100 μm, or 150 μm, or 200 μm to 250 μm, or 300 μm, or 350 μm, or 400 μm, or 500 μm, or 600 μm, or 700 μm, or 800 μm, or 900 μm, or 1000 μm.

In an embodiment, the diameter, D, is from 300 μm, or 400 μm, or 500 μm to 600 μm, or 700 μm, or 800 μm, or 900 μm or 1000 μm.

The channels 20 may or may not be parallel with respect to each other. The term "parallel," as used herein, indicates the channels extend in the same direction and never intersect.

In an embodiment, the channels 20 are parallel.

In an embodiment, the channels 20 are not parallel, or are non-parallel.

A spacing, S, of matrix 18 (polymeric material) is present between the channels 20, as shown in FIG. 3. In an embodiment, the spacing, S, is from 1 micrometer (μm), or 5 μm, or 10 μm, or 25 μm, or 50 μm, or 100 μm, or 150 μm, or 200 μm to 250 μm, or 300 μm, or 350 μm, or 400 μm, or 500 μm, or 1000 μm, or 2000 μm or 3000 μm.

The microcapillary strip 10 has a thickness, T, and a width, W as shown in FIG. 3. In an embodiment, the thickness, T, is from 10 μm, or 20 μm, or 30, or 40 μm, or 50 μm, or 60 μm, or 70 μm, or 80 μm, or 90 μm, or 100 μm to 200 μm, or 500 μm, or 1000 μm, or 1500 μm, or 2000 μm.

In an embodiment, the short axis of the microcapillary strip 10 is from 20%, or 30%, or 40%, or 50% to 60% to 70% to 80% of the thickness, T. The "short axis" is the shortest axis of the channel 20 from the cross section point of view. The shortest axis is typically the "height" of the channel considering the microcapillary strip in a horizontal position.

In an embodiment, the microcapillary strip 10 has a thickness, T, from 50 μm, or 60 μm, or 70 μm, or 80 μm, or 90 μm, or 100 μm to 200 μm, or 500 μm, or 1000 μm, or 1500 μm, or 2000 μm. In a further embodiment, the microcapillary strip 10 has a thickness, T, from 600 μm to 1000 μm.

In an embodiment, the microcapillary strip 10 has a width, W, from 0.5 centimeter (cm), or 1.0 cm, or 1.5 cm, or 2.0 cm, or 2.5 cm, or 3.0 cm, or 5.0 cm to 8.0 cm, or 10.0 cm, or 20.0 cm, or 30.0 cm, or 40.0 cm, or 50.0 cm, or 60.0 cm, or 70.0 cm, or 80.0 cm, or 90.0 cm, or 100.0 cm.

In an embodiment, the microcapillary strip 10 has a width, W, from 0.5 cm, or 1.0 cm, or 2.0 cm to 2.5 cm, or 3.0 cm, or 4.0 cm, or 5.0 cm.

In an embodiment, the microcapillary strip 10 has a length from 0.1 cm, or 0.5 cm, or 1.0 cm, or 2.0 cm, or 3.0 cm, or 5.0 cm to 7.0 cm, or 10.0 cm.

In an embodiment, the channels 20 have a diameter, D, from 300 μm to 1000 μm; the matrix 18 has a spacing, S, from 300 μm to 2000 μm; and the microcapillary strip 10 has a thickness, T, from 50 μm to 2000 μm and a width, W, from 1.0 cm to 4.0 cm.

The microcapillary strip 10 may comprise at least 10 percent by volume of the matrix 18, based on the total volume of the microcapillary strip 10; for example, the microcapillary strip 10 may comprise from 90 to 10 percent by volume of the matrix 18, based on the total volume of the microcapillary strip 10; or in the alternative, from 80 to 20 percent by volume of the matrix 18, based on the total volume of the microcapillary strip 10; or in the alternative, from 80 to 30 percent by volume of the matrix 18, based on the total volume of the microcapillary strip 10; or in the alternative, from 80 to 50 percent by volume of the matrix 18, based on the total volume of the microcapillary strip 10.

The microcapillary strip 10 may comprise from 10 to 90 percent by volume of voidage, based on the total volume of the microcapillary strip 10; for example, the microcapillary strip 10 may comprise from 20 to 80 percent by volume of voidage, based on the total volume of the microcapillary strip 10; or in the alternative, from 20 to 70 percent by volume of voidage, based on the total volume of the microcapillary strip 10; or in the alternative, from 20 to 50 percent by volume of voidage, based on the total volume of the microcapillary strip 10.

The matrix 18 is composed of one or more polymeric materials. Nonlimiting examples of suitable polymeric materials include ethylene/$C_3$-$C_{10}$ α-olefin copolymers linear or branched; ethylene/$C_4$-$C_{10}$ α-olefin copolymers linear or branched; propylene-based polymer (including plastomer and elastomer, random propylene copolymer, propylene homopolymer, and propylene impact copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid or ethylene-methacrylic acid and their ionomers with zinc, sodium, lithium, potassium, magnesium salts; ethylene vinyl acetate copolymers; and blends thereof.

In an embodiment, the matrix 18 is composed of one or more of the following polymers: enhanced polyethylene resin ELITE™ 5100G with a density of 0.92 g/cc by ASTM D792, a Melt Index of 0.85 g/10 min@190° C., 2.16 kg by ASTM D1238, and melt temperature of 123° C.; low density polyethylene resin DOW™ LDPE 501I with a density of 0.922 g/cc by ASTM D792, a Melt Index of 1.9 g/10 min@190 C, 2.16 kg, and a melting temperature of 111° C.; high density polyethylene resin UNIVAL™ DMDA-6400 NT7 with a density of 0.961 g/cc by ASTM D792, a Melt Index of 0.8 g/10 min@190° C., 2.16 kg, and a melting temperature of 111° C.; polypropylene Braskem™ PP H314-02Z with a density of 0.901 g/cc by ASTM D792, a Melt Index of 2.0 g/10 min@230° C., 2.16 kg, and a melting temperature of 163° C.; ethylene/$C_4$-$C_{12}$ α-olefin multi-block copolymer such INFUSE™ 9817, INFUSE™ 9500, INFUSE™ 9507, INFUSE™ 9107, and INFUSE™ 9100 available from The Dow Chemical Company.

In an embodiment, the matrix 18 is composed of a blend of HDPE and LDPE. The HDPE/LDPE blend contains from 75 wt %, or 80 wt % to 85 wt %, or 90 wt % HDPE and a reciprocal amount of LDPE, or from 25 wt % or 20 wt % to 15 wt %, or 10 wt % of LDPE. Weight percent is based on the total weight of the matrix 18.

In an embodiment, the matrix 18 is composed of a polymeric blend of LLDPE and LDPE. The LLDPE/LDPE blend contains from 75 wt %, or 80 wt % to 85 wt %, or 90 wt % LLDPE and a reciprocal amount of LDPE, or from 25 wt % or 20 wt % to 15 wt %, or 10 wt % of LDPE. Weight percent is based on the total weight of the matrix 18. In a further embodiment, the matrix 18 is a blend of LLDPE ELITE 5100 (available from The Dow Chemical Company) and LDPE 501I LDPE (available from the Dow Chemical Company) in the respective LLDPE and LDPE weight percent ranges set forth in this paragraph.

In an embodiment, the matrix 18 is composed of a blend of 80 wt % LLDPE and 20 wt % LDPE. Weight percent is based on the total weight of the matrix 18.

2. Flexible Films

The present flexible bag includes opposing flexible films. Each flexible film can be a monolayer film or a multilayer film. The two opposing films may be components of a single (folded) sheet (or web) wherein ends of the sheet are folded upon themselves and subsequently sealed together. Alternatively, the flexible films may be separate and distinct films, i.e., a first flexible film and an opposing second flexible film. The composition of each flexible film can be the same or can be different. The structure of each flexible film can be the same or can be different.

In an embodiment, each flexible film is a flexible multilayer film having at least two, or at least three layers. The flexible multilayer film is resilient, flexible, deformable, and pliable. The structure and composition for each of the two flexible multilayer films may be the same or different. For example, each of the two flexible films can be made from a separate web, each web having a unique structure and/or unique composition, finish, or print.

In an embodiment, the flexible bag is formed from opposing flexible films that are multilayer flexible films. Each flexible film may be (i) a coextruded multilayer structure, (ii) a laminate, or (iii) a combination of (i) and (ii). In an embodiment, each flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, each flexible multilayer film is a coextruded film having at least two, or three, or four, or five, or six, or seven to eight, or nine, or ten, or eleven, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers reinforcing agents, and combinations thereof as disclosed above for the monolayer film.

Each flexible multilayer film is composed of one or more polymeric materials. Nonlimiting examples of suitable polymeric materials for the seal layer include olefin-based polymer including any ethylene/$C_3$-$C_{10}$ α-olefin copolymers linear or branched; ethylene/$C_4$-$C_{10}$ α-olefin copolymers linear or branched; propylene-based polymer (including plastomer and elastomer; and random propylene copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid, ethylene vinyl acetate, or ethylene-methacrylic acid and their ionomers with zinc, sodium, lithium, potassium, magnesium salts; ethylene vinyl acetate copolymers; and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6; Nylon 6,6; Nylon 6,66; Nylon 6,12; Nylon 12; etc.), polyethylene norbornene, cyclic olefin copolymers, polyacrylonitrile, polyesters, copolyesters (such as polyethylene terephthlate glycol-modified (PETG)), cellulose esters, polyethylene and copolymers of ethylene (e.g., LLDPE based on ethylene octene copolymer such as DOWLEX™), blends thereof, and multilayer combinations thereof.

Nonlimiting examples of suitable polymeric materials for tie layer include functionalized ethylene-based polymers such as ethylene-vinyl acetate (EVA) copolymer; polymers with maleic anhydride-grafted to polyolefins such as any polyethylene, ethylene-copolymers, or polypropylene; and ethylene acrylate copolymers such an ethylene methyl acrylate (EMA); glycidyl containing ethylene copolymers; propylene and ethylene based olefin block copolymers such as INFUSE™ (ethylene-based Olefin Block Copolymers available from the Dow Chemical Company) and INTUNE™ (PP-based Olefin Block Copolymers available from The Dow Chemical Company); and blends thereof.

Each flexible multilayer film may include additional layers which may contribute to the structural integrity or provide specific properties. The additional layers may be added by direct means or by using appropriate tie layers to the adjacent polymer layers. Polymers which may provide additional performance benefits such as stiffness, toughness or opacity, as well as polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN™ resins available from The Dow Chemical Company); vinylethylene vinyl alcohol (EVOH) copolymer; and metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)); single-site LLDPE substantially linear, or linear ethylene alpha-olefin copolymers, including polymers sold under the trade name AFFINITY™ or ELITE™ (The Dow Chemical Company) for example; propylene-based plastomers or elastomers such as VERSIFY™ (The Dow Chemical Company); and blends thereof. An optional tie layer is selected from either ethylene-based olefin block copolymer INFUSE™ Olefin Block Copolymer (available from The Dow Chemical Company) or propylene-based olefin block copolymer such as INTUNE™ (available from The Dow Chemical Company), and blends thereof. The outer layer includes greater than 50 wt % of resin(s) having a melting point, Tm, that is from 25° C. to 30° C., or 40° C. higher than the melting point of the polymer in the seal layer wherein the outer layer polymer is comprised of resins such as DOWLEX™ LLDPE, ELITE™ enhanced polyethylene resin, MDPE, HDPE, or a propylene-based polymer such as VERSIFY™, VISTAMAX™, propylene homopolymer, propylene impact copolymer, or TPO.

In an embodiment, the flexible multilayer film is coextruded.

In an embodiment, flexible multilayer film includes a seal layer selected from LLDPE (sold under the trade name DOWLEX™ (The Dow Chemical Company)); single-site LLDPE (substantially linear, or linear, olefin polymers, including polymers sold under the trade name AFFINITY™ or ELITE™ (The Dow Chemical Company) for example); propylene-based plastomers or elastomers such as VERSIFY™ (The Dow Chemical Company); and blends thereof. The flexible multilayer film also includes an outer layer that is a polyamide.

In an embodiment, each flexible film is a monolayer film. FIGS. 1, 2, 3, and 3A show an embodiment wherein the flexible bag 2 includes two flexible films, flexible film 22 (first flexible film) and flexible film 24 (opposing second flexible film). Each flexible film 22, 24 is a monolayer film. Each flexible film 22, 24 is resilient, flexible, deformable, and pliable. Each flexible film 22, 24 has the same composition of polymeric material.

In an embodiment, the composition for each monolayer flexible film 22, 24 is the same and the composition is a polymeric material that is a blend of LLDPE and LDPE. The blend of polymeric material for the monolayer flexible films 22, 24 contains from 70 wt %, or 75 wt %, or 80 wt % to 85 wt %, or 90 wt %, or 95 wt % LLDPE and a reciprocal amount of LDPE, or from 30 wt %, or 25 wt %, or 20 wt % to 15 wt %, or 10 wt %, or 5 wt % LDPE. In a further embodiment, each flexible film 22, 24 is composed solely of the LLDPE/LDPE blend (and optional additives) in the weight ratios presented in this paragraph. Nonlimiting examples of suitable (optional) additives that may be present in each flexible film include stabilizers, slip additives, antiblocking additives, process aids, clarifiers, nucleators, pigments or colorants, fillers, reinforcing agents, and combinations thereof.

In an embodiment, each flexible film 22, 24 is a monolayer film composed of 90 wt % LLDPE and 10 wt % LDPE. A nonlimiting example of suitable LLDPE is DOWLEX 2045G available from The Dow Chemical Company. A nonlimiting example of a suitable LDPE is LDPE 132I available from The Dow Chemical Company.

3. Common Peripheral Edge

The opposing flexible films 22 and 24 are superimposed on each other and form a common peripheral edge 26, as shown in FIG. 1. The common peripheral edge 26 defines a perimeter shape for the flexible bag. The perimeter shape for the flexible bag 2 can be a polygon (such as triangle, square, rectangle, diamond, pentagon, hexagon, heptagon, octagon, etc.) or an ellipse (such as an ovoid, an oval, or a circle).

The microcapillary strip 10 is located between the flexible film 22 and opposing flexible film 24. The microcapillary strip 10 may or may not extend along the entire length of one side of the polygon (for the perimeter edge). FIG. 1 shows an embodiment wherein the microcapillary strip 10 extends along only a portion of the length of one side of the polygon—namely, along a portion of one side of the perimeter polygon shape of a rectangle for flexible bag 2.

A peripheral seal 28 extends along at least a portion of the common peripheral edge 26. The peripheral seal 28 seals, or otherwise adheres, flexible film 22 to flexible film 24. The peripheral seal 28 also seals, or otherwise adheres, the microcapillary strip 10 between the flexible film 22 and opposing flexible film 24. The peripheral seal 28 seals the microcapillary strip 10 between the opposing flexible films 22, 24 and forms a hermetic seal therebetween. The peripheral seal 28 is formed by way of ultrasonic seal, heat seal, adhesive seal, and combinations thereof.

In an embodiment, the peripheral seal 28 is formed by way of a heat sealing procedure. The term "heat sealing," as used herein, is the act of placing two or more films of polymeric material between opposing heat seal bars, the heat seal bars moved toward each other, sandwiching the films, to apply heat and pressure to the films such that opposing interior surfaces (seal layers) of the films contact, melt, and form a heat seal, or a weld, to attach the films to each other. Heat sealing includes suitable structure and mechanism to move the seal bars toward and away from each other in order to perform the heat sealing procedure.

In an embodiment, the seal between the microcapillary strip 10 and the flexible films 22, 24 occurs at a seal condition 1. The seal condition 1 is sufficient: (i) to fuse polymeric material of matrix 18 to the flexible films 22, 24 and form a hermetic seal between the microcapillary strip 10 and flexible films 22 and 24 and (ii) to fuse the polymeric material of flexible film 22 to opposing flexible film 24 and form a hermetic seal between flexible film 22 and flexible film 24.

In an embodiment, heat seal condition (1) may entail a seal pressure that deforms, collapses or otherwise crushes one, some, or all of the channels 20 of the microcapillary strip 10. Applicant discovered that although capillary deformation or collapse may occur during heat sealing, the ability of the microcapillary strip 10 to degas, or otherwise exhaust, residual air from the flexible bag interior remains intact.

The peripheral seal 28 extends along at least a portion of the common peripheral edge 26. In an embodiment, the peripheral seal 28 extends along the entire peripheral edge 26 as shown in FIG. 1.

FIG. 1 shows the peripheral seal 28 forms a closed compartment 30 within the flexible bag 2. An amount of a flowable solid particulate material 32 is present in the closed compartment 30. A "flowable solid particulate material" (interchangeably used with "FSPM"), as used herein, is a solid composed of a large number of particles that (i) flow freely when shaken or tilted, and/or (ii) flows freely through a conduit without the aid of additional flow enhancing steps such as fluidizing, for example.

In an embodiment, the FSPM has a D50 from 1 μm to 1000 μm, wherein D50 is measured in accordance with ISO 13320 (Particle size analysis—Laser diffraction method). The term "D50," as used herein, signifies the point in a particle size distribution, up to and including which, 50% of the total volume of material in the sample is contained. For example, if the D50 for the FSPM is 200 μm, this means that 50% of the FSPM sample has a particle size of 200 μm or smaller. In a further embodiment, the particles in the FSPM have a D50 from 1 μm, or 5 μm, or 10 μm, or 25 μm, or 50 μm, or 75 μm, or 100 μm, or 150 μm, or 200 μm, or 250 μm, or 300 μm, or 400 μm, or 500 μm to 600 μm, or 700 μm, or 800 μm, or 900 μm, or 1000 μm.

Nonlimiting examples of FSPM include powders, grains, pellets, granular solids, pebbles, and combinations thereof. Further nonlimiting examples of FSPM include flour (D50, 1-200 μm), cement (D50 1-100 μm), sugar cubes (D50 ~1 cm), coarse sugar (D50 ~1000 μm), caster sugar (D50 ~500 μm), icing sugar (D50 ~50 μm and less), ultra-fine sugar (D50 ~6 μm), whole dried milk (D50 ~98 μm), wheat (D50 ~23 μm), starch (D50 ~30 μm), salt (D50 ~1180 μm), and any combination thereof.

In an embodiment, the flexible bag is a heavy duty flexible bag. A "heavy duty flexible bag," as used herein, is a flexible bag as described above wherein each flexible film has a thickness from 0.050 mm, or 0.10 mm, or 0.15 mm, or 0.20 mm to 0.25 mm, or 0.30 mm, or 0.4 mm. In addition, the heavy duty flexible bag contains a bulk amount of FSPM 32. A "bulk amount of FSPM," as used herein, is from 4.5 kilograms (kg), or 5 kg, or 10 kg, or 15 kg, or 20 kg to 25 kg, or 30 kg, or 35 kg, or 40 kg or 45 kg of the FSPM.

Figure 4:
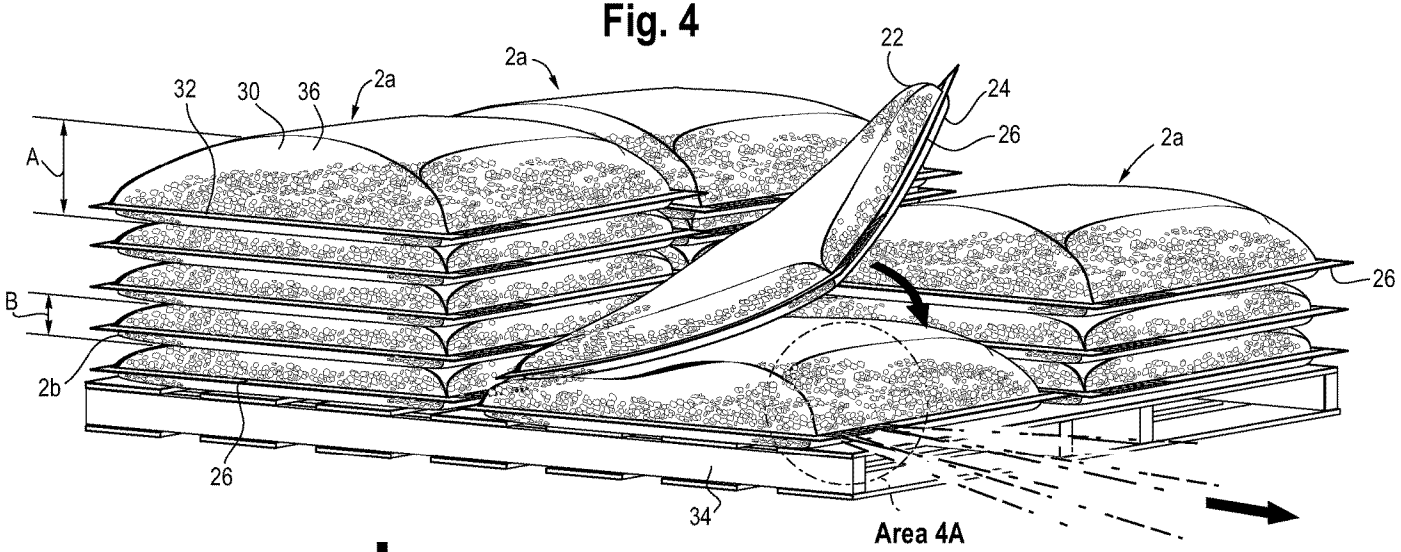
FIG. 4 is a perspective view of a stacking procedure of heavy duty flexible bags in accordance with an embodiment of the present disclosure.
Figure 4A:
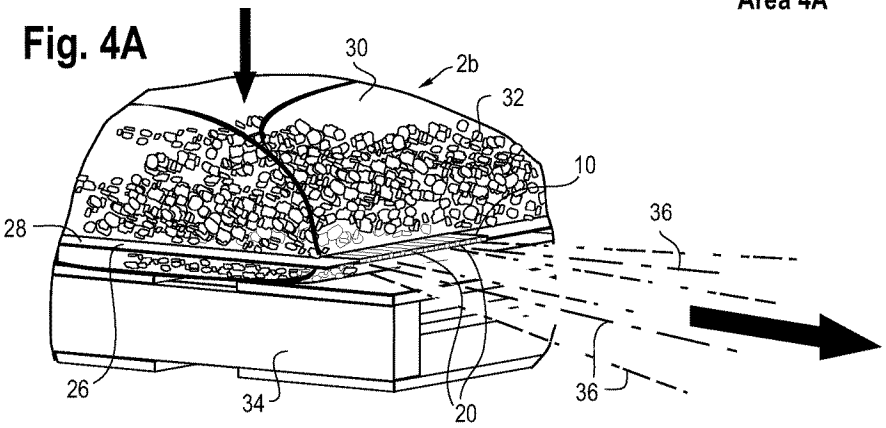
FIG. 4A is an enlarged perspective view of Area 4A of FIG. 4.

In an embodiment, FIGS. 4, 4A show flexible bags 2*a*, 2*b* that are heavy duty flexible bags, the flexible films 22, 24 for each heavy duty flexible bag 2*a*, 2*b* being the same composition (HDPE/LLDPE blend) and the same structure (monolayer film), each flexible film 22, 24 for heavy duty flexible bags 2*a*, 2*b* having a thickness from 0.10 mm, or 0.15 mm to 0.20 mm, or 0.25 mm. Each heavy duty flexible bag 2*a*, 2*b* holds a bulk amount—from 4.5 kg to 45 kg—of FSPM 32 within the storage compartment 30.

The microcapillary strip 10 enables residual air that is present in the closed compartment to be evacuated from the closed compartment 30. FIGS. 4, 4A show an embodiment wherein heavy duty bags are stacked, on top of one another, on a pallet 34. The stacked heavy duty flexible bags include un-evacuated heavy duty flexible bags 2*a* and evacuated heavy duty flexible bags 2*b*. Un-evacuated heavy duty flexible bags 2*a* contain residual air 36 in the closed compartment 30. The presence of residual air 36 in the compartment 30 provides un-evacuated heavy duty flexible bags 2*a* a height A as shown in FIG. 4. When one heavy duty flexible bag is placed, or otherwise stacked, upon another heavy duty flexible bag, the weight of the upper heavy duty flexible bag applies an inward force upon the lower heavy duty flexible bag. The inward force pushes residual air 36 from the closed compartment 30 of the lower heavy duty flexible bag, through the channels 20 of microcapillary strip 10, and out of the closed container 30 as shown in FIG. 4A. When the residual air 36 is evacuated from the closed compartment, the heavy duty flexible bag becomes an evacuated heavy duty flexible bag 2*b*. The evacuated heavy duty flexible bag 2*b* has a height B as shown in FIG. 4. The distance of height A for the un-evacuated heavy duty flexible bag 2*a* is greater than the height B for the evacuated heavy duty flexible bag 2*b*.

Although FIGS. 4 and 4*a* show the stacking heavy duty flexible bags upon each other as a procedure for evacuating residual air, it is understood that other methods or procedures (for example, pressure applied by hand or by pushing on a top plate, pulling a vacuum on the outward facing end of the microcapillary strip, etc.) may be employed to impart an inward force upon the heavy duty flexible bags to degas, or otherwise to evacuate, the residual air from the closed chamber.

In an embodiment, the flexible bags are filled with polymer resin pellets and are de-aired, or otherwise de-gassed, before stacking. The flexible bags are perforated prior to filling with the polymer resin pellets. The flexible bags are filled and sealed upright. The filled flexible bags are subsequently placed side-down on a conveyor belt for transport to a palletization unit. On the way the to the palletization unit, the flexible bags pass through one or more degassing rollers or platens. The rollers are set at pre-determined height or gap (e.g., 4 inches, for example) which squeeze the flexible bags, for degassing. The rollers prepare the flexible bags for palletizing.

In an embodiment, the microcapillary strip 10 is fabricated so that the length of the channels 20 of the microcapillary strip 10 prevent moisture from entering into the closed compartment 30 due to frictional flow resistance. The matrix 18 can be made of a non-wetting (hydrophobic) material to prevent moisture from entering into the closed compartment 30 by way of capillary action.

In an embodiment, the microcapillary channels 20 can be closed by a heat sealer after the packing process is completed to prevent passage of any material external to the heavy duty flexible bag from entering into the closed compartment 30.

4. Perforated Film

Figure 5:
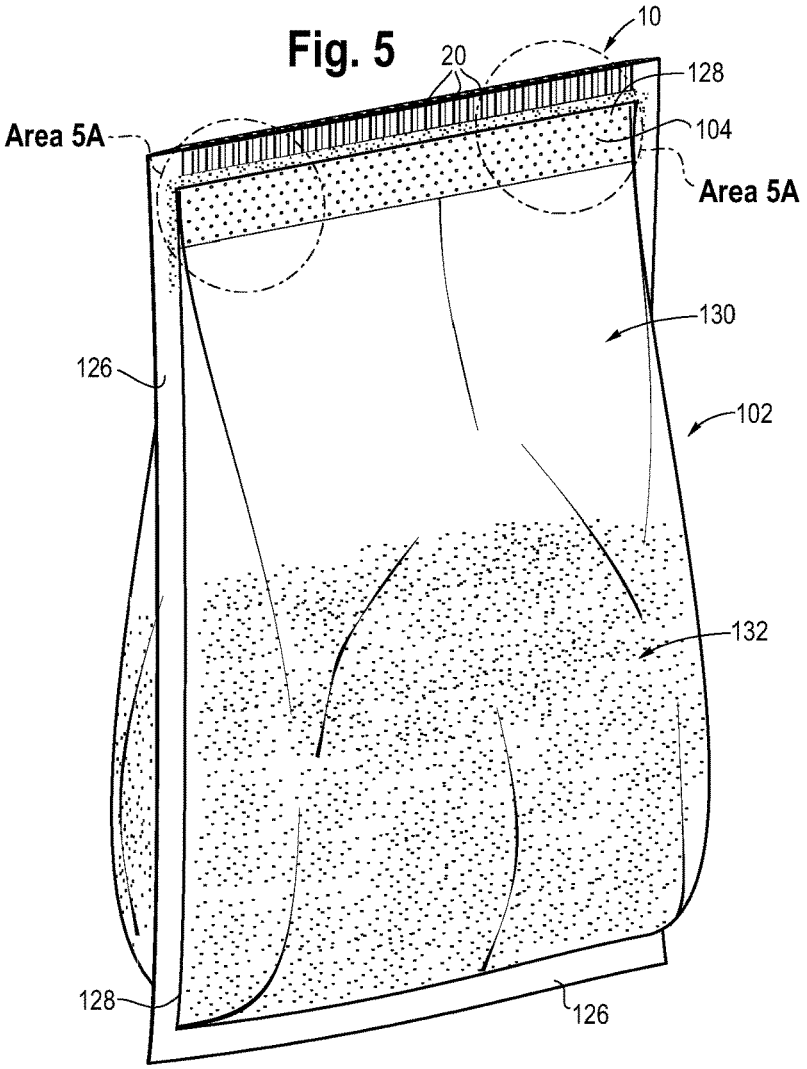
FIG. 5 is a perspective view of a flexible bag in accordance with another embodiment of the present disclosure.
Figure 5A:
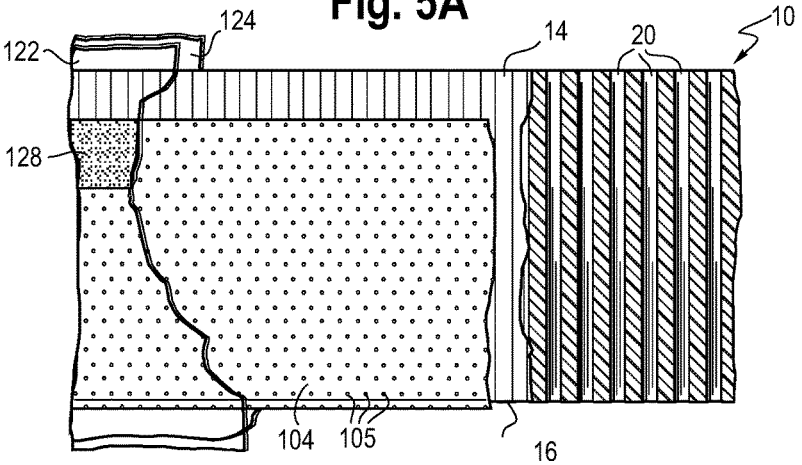
FIG. 5A is an enlarged cutaway plan view of Area 5A of FIG. 5.
Figure 5B:
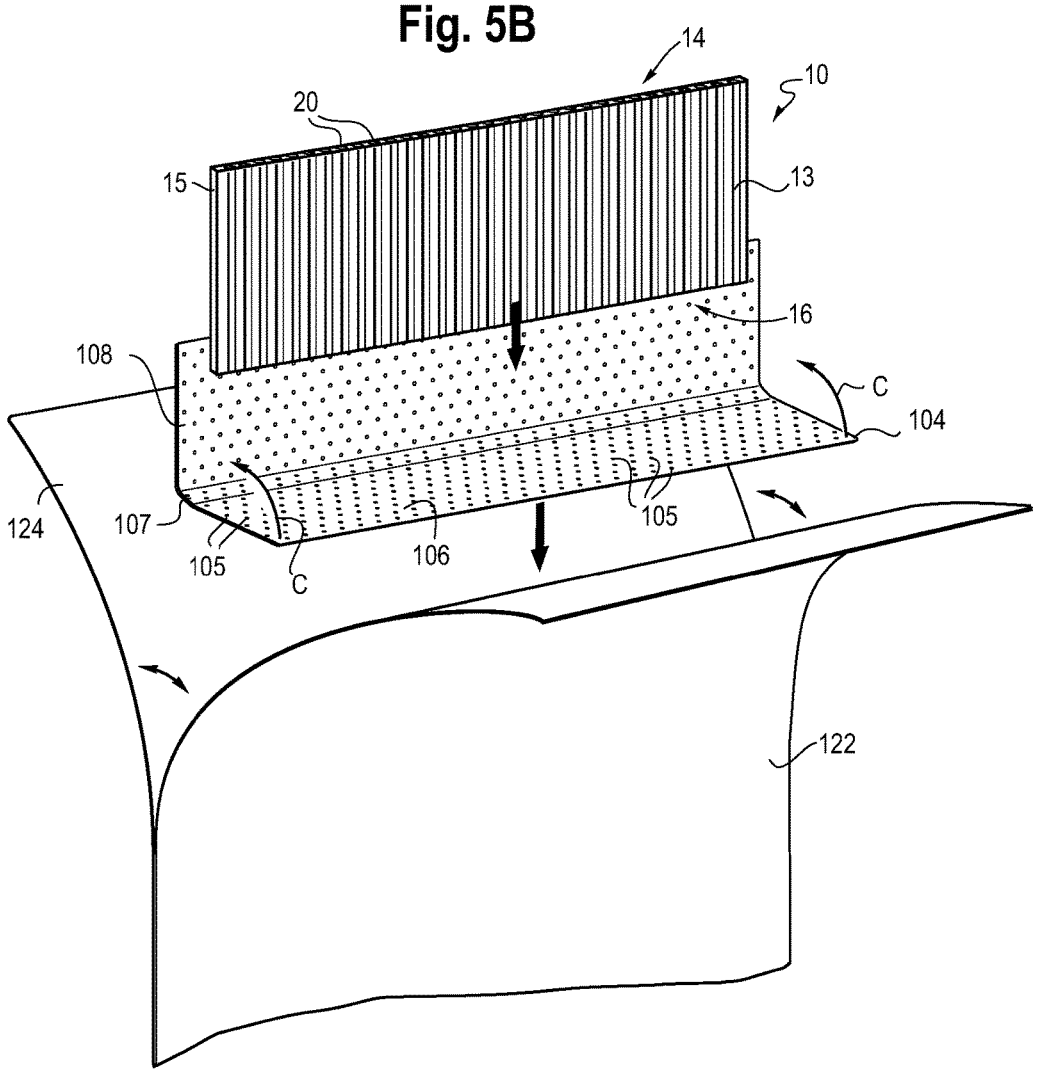
FIG. 5B is an exploded view of the flexible bag of FIG. 5 showing the flexible films, the perforated film, and the microcapillary strip.

FIGS. 5, 5A, 5B, and 6 show an embodiment wherein a flexible bag 102 includes a microcapillary strip 10. Microcapillary strip 10 can be any microcapillary strip as disclosed above. The microcapillary strip 10 has a first end 14 and an opposing second end 16 as best shown in FIG. 5B. The channels 20 extend from the first end 14 to the second end 16.

A perforated film 104 covers at least one of the ends 14, 16 of the microcapillary strip 10. The perforated film 104 includes a plurality of perforations 105. The perforations 105 extend through the entire thickness of the perforated film 104. In an embodiment, the perforations 105 are disposed in a spaced-apart manner on the perforated film 104. In a further embodiment, the perforations 105 are evenly spaced apart about the perforated film 104, the perforations 105 having a diameter from 0.5 μm, or 1 μm, or 5 μm, or 10 μm, or 25 μm, or 50 μm, or 75 μm, or 100 μm to 125 μm, or 150 μm, or 175 μm, or 200 μm.

In an embodiment, FIG. 5B shows the perforated film 104 covering the end 16 of the microcapillary strip 10. It is understood that the perforated film 106 may cover the end 16, alone, or in combination with covering the end 14. Alternatively, the perforated film 106 may cover end 14 only.

The perforations 105 are in fluid communication with the channels 20 of the microcapillary strip 10. In an embodiment, one or more perforations 105 are in fluid communication with each channel 20 in the microcapillary strip 10. The channels 20, in combination with the perforations 105, provide a pathway through which residual air can be evacuated from the closed chamber.

In an embodiment, the perforated film 104 is folded over a portion of the microcapillary strip 10 in addition to the perforated film 104 covering an end of the microcapillary strip. Arrows C in FIG. 5B show how the perforated film 104 is folded, or otherwise is wrapped, around the microcapillary strip 10. A first portion 106 of the perforated film 104 contacts at least a portion of (or all of) a first surface 13 of the microcapillary strip 10. A second portion 107 of the perforated film 104 contacts, and covers, the end 16 of the microcapillary strip 10. A third portion 108 of the perforated film 104 contacts a second surface 15 of the microcapillary strip 10.

Opposing flexible films 122, 124 are superimposed upon each other to form a common peripheral edge 126 as previously disclosed herein. A peripheral seal 128 extends along at least a portion of the common peripheral edge 126 as previously disclosed herein.

The flexible bag 102 includes a peripheral seal 128. The peripheral seal 128 extends along at least a portion of the common peripheral edge 126 as previously disclosed herein. The peripheral seal 128 seals, or otherwise adheres, flexible film 122 to flexible film 124. The peripheral seal 128 also seals, or otherwise adheres, the microcapillary strip 10 between first portion 106 and third portion 108 of the perforated film 104. The peripheral seal 128 concomitantly seals flexible film 122 to the first portion 106 and seals flexible film 124 to the third portion 108. From inward to outward, the microcapillary strip 10 is sealed between the first portion 106 and third portion 108 and the microcapillary strip 10 is also sealed between opposing flexible films 122, 124. The peripheral seal 128 forms a hermetic seal between the microcapillary strip 10, the first/third portions 106, 108 and the flexible films 122, 124. The peripheral seal 128 is formed by way of ultrasonic seal, heat seal, adhesive seal, and combinations thereof.

In an embodiment, the peripheral seal 128 (i) seals the microcapillary strip 10 to the first portion and third portion 106, 108, (ii) seals first portion 106 and third portion 108 to respective flexible films 122 and 124, and (iii) seals flexible film 122 to flexible film 124 by way of a heat seal condition 2. The heat seal condition 2 is sufficient: (i) to fuse polymeric material of matrix 18 to the first portion 106 and to the third portion 108, (ii) to fuse the first portion 106 and the third portion 108 to respective flexible films 122, 124 and form a hermetic seal between the microcapillary strip 10, the portions 106, 108 and flexible films 122 and 124 and (ii) to fuse the polymeric material of flexible film 122 to opposing flexible film 124 and form a hermetic seal between the flexible films 122, 124, the portions 106, 108 and the microcapillary strip 10.

In an embodiment, heat seal condition 2 may entail a seal pressure that deforms, collapses or otherwise crushes one, some, or all of the channels 20 of the microcapillary strip 10. Applicant discovered that although capillary deformation or collapse may occur during heat seal condition 2, the ability of the microcapillary strip 10 to degas, or otherwise exhaust, residual air from the flexible bag interior remains intact.

The peripheral seal 128 forms a closed compartment 130 as previously disclosed herein. An amount of flowable solid particulate material 132 in located in the closed compartment 130.

In an embodiment, the diameter of perforations 105 is equal to or less than the D50 particle size of flowable solid particulate material. In a further embodiment, the diameter of perforations is from 0.5× to 1.0× of the D50 for the FSPM.

Figure 6:
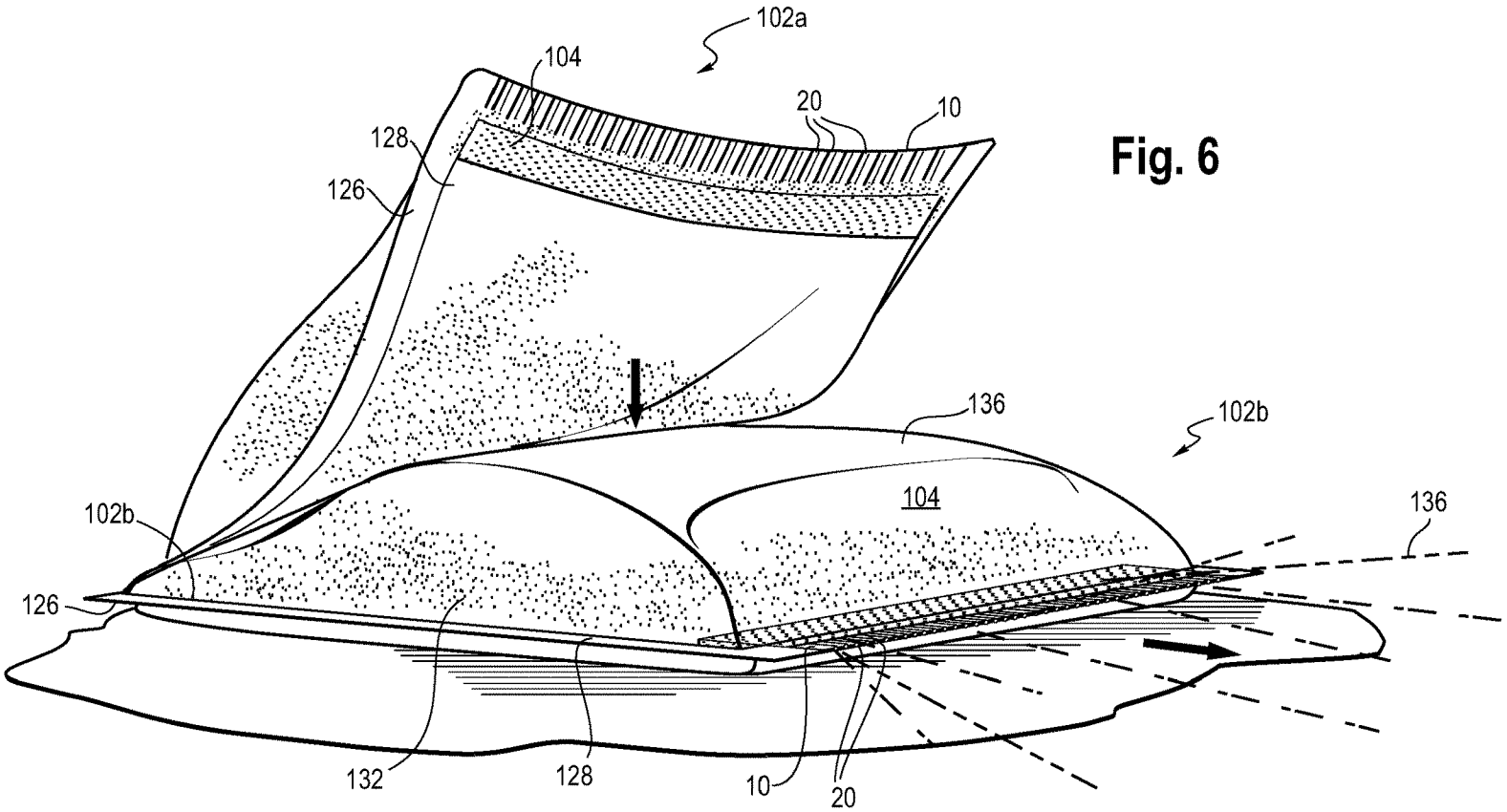
FIG. 6 is a perspective view of a stacking procedure of heavy duty flexible bags in accordance with an embodiment of the present disclosure.

The microcapillary strip 10 enables residual air 136 that is present in the closed compartment 130 to be evacuated from the closed compartment. FIG. 6 shows an embodiment wherein heavy duty bags 102*a*, 102*b* are stacked, on top of one another. The stacking pushes residual air 136 in the lower heavy duty flexible bag 102*b* through the perforations 105 of the perforated film 104 and through the channels 20 of the microcapillary strip 10. The microcapillary strip 10 is fabricated so the length of the channels 20 prevents water/moisture from entering into the closed container. The matrix 18 may be constructed of a hydrophobic material to prevent water/moisture from entering into the closed container. The perforations 105 permit residual air 136 to push through the microcapillary strip 10 while preventing some (or all) dust from leaving the closed compartment 30.

By way of example, and not limitation, some embodiments of the present disclosure will now be described in detail in the following Examples.

EXAMPLES

A. Components

1. Microcapillary Strip

A microcapillary strip is fabricated having the following dimensions/material set forth in Table 1 below.

TABLE 1

| Microcapillary strip | |
|---|---|
| Microcapillary strip | |
| Dimensions | 2 cm × 5 cm |
| Thickness | 0.50 mm |
| Channel shape | oval shape, approximately 1.00 mm width by 0.3 mm height |
| Channel spacing | 0.10 mm |
| Material | Polymeric blend of ELITE 5100/LDPE 501I (80/20, wt %)<br>ELITE 5100-LLDPE ethylene/octene copolymer, density 0.920 g/cc, MI 0.85 g/10 min, Tm 124° C.<br>LDPE 501I-LDPE density of 0.920 g/cc, MI 1.90 g/10 min, Tm 111° C. |

2. Flexible Film

A monolayer film 0.112 mm (4.5 mil) thick composed of 90 wt % DOWLEX™ 2045G LLDPE (available from The Dow Chemical Company) and 10 wt % LDPE 132i (available from The Dow Chemical Company) is produced on a blown film line using a single screw 88.9 mm (3.5 inch) diameter 30:1 L/D Sterling extruder outputting 113.4 kg/hr (250 lbs/hour) to a 203 mm (8 inch) diameter die (Gloucester). The line is operated at a rate of about 178 g/hr/mm die circumference at 2:1 blow up ratio (BUR) as typical used in the industry for form-fill-seal (FFS) films. The film is cooled with IBC (internal bubble cooling) and external cooling provided by a Hosokowa Alpine air ring operating in sequence with a Kundig gauge scanner to control gauge variation. Frost line height is kept around 81 cm (32 inches). The film is then passed onto a single turret Gloucester winder operating at a maximum speed of 305 m/min (1000 ft/min) and collected on a 76 mm (3 inch) core for sampling. The film is hereafter referred to as "Film 1."

B. Sealing Process

Two opposing films of Film 1 are provided with the seal layers facing each other and arranged to form a common peripheral edge. The microcapillary strip is placed between the two opposing Film 1 films at the top of the powdery bag. The assembly is heat sealed using an Accu-Seal 540 Plus® sealer from Accu-Seal SencorpWhite, Inc. The opposing seal jaws consist of an impulse heating bar on the lower jaw which is covered by Teflon tape and a pressure bar on the top jaw which is also covered by Teflon tape. The sealing temperature is 143° C., the sealing time is 5 seconds, and the sealing pressure is 6 bar (0.62 MPa, 90 psi). To ensure the seal quality, after the first seal, the Film1-strip-Film1 assembly is flipped over and sealed again in the same location and using the same sealing conditions. The sealing process results in complete adhesion of the microcapillary strip outer surfaces to the seal layers of the films' inner surfaces (opposing Film1-Film1) without significant change to the microcapillary structure as observed with optical microscope images. In other words, after the sealing process, the channel shape remains oval shape, the oval having a 1.00 mm width and a 0.3 mm height. The peel strength of the sealed microcapillary-film structure is 0.41 MPa/25.4 mm (1 inch) width of seal. The seal process results in a flexible bag with a microcapillary strip as shown in FIG. 1.

The (i) size of the channels and (ii) the number of the channels in the microcapillary strip can be tailored in order to obtain a flexible bag with microcapillary strip (as produced above and as shown in FIG. 1) wherein the air flow through the channels is 20 $m^3$/hr. The cross-section of microcapillary channels has an oval shape. The long axis (width), the short axis (height) of the channel and as well as the number of channels determine the air flow rate. The pressure applied on the flexible bag with microcapillary strip also influences the air flow rate. The two pressures evaluated are 0.5 psig and 1.0 psig. The required number of channels to achieve 20 $m^3$/hr air flow from the flexible bag ranges from 25 channels to 410 channels depending of the channel size as shown in Table 2 below.

Flexible bags with microcapillary strip as fabricated as described above (and as shown in FIG. 1) can be produced with microcapillary strips 1-13 shown in Table 2 below.

TABLE 2

Microcapillary strips for obtaining 20 $m^3$/hr air flow from flexible bag

| | CAPILLARY PARAMETERS | | | | | |
|---|---|---|---|---|---|---|
| Microcapillary strip sample # | Number of channels to get ~20 $m^3$/hr air flow | Length mm | Oval width um | Oval height um | Pressure applied to bag psig | Flow Regime |
| 1 | 245 | 10 | 1028 | 361 | 0.50 | turbulent-transition |
| 2 | 250 | 10 | 873.8 | 306.85 | 0.50 | transition-laminar |
| 3 | 315 | 10 | 822.4 | 288.8 | 0.50 | transition-laminar |
| 4 | 410 | 10 | 771 | 270.75 | 0.50 | laminar |
| 5 | 185 | 10 | 1130.8 | 397.1 | 0.50 | turbulent-transition |
| 6 | 145 | 10 | 1233.6 | 433.2 | 0.50 | turbulent-transition |
| 7 | 95 | 10 | 1439.2 | 505.4 | 0.50 | turbulent |
| 8 | 70 | 10 | 1644.8 | 577.6 | 0.50 | turbulent |
| 9 | 40 | 10 | 2056 | 722 | 0.50 | turbulent |
| 10 | 160 | 10 | 1028 | 361 | 1.00 | turbulent-transition |
| 11 | 45 | 10 | 1644.8 | 577.6 | 1.00 | turbulent |
| 12 | 25 | 10 | 2056 | 722 | 1.00 | turbulent |
| 13 | 180 | 10 | 1028 | 433.2 | 0.50 | turbulent-transition |
| 14 | 140 | 10 | 1028 | 505.4 | 0.50 | turbulent |
| 15 | 115 | 10 | 1028 | 577.6 | 0.50 | turbulent |
| 16 | 160 | 5 | 1028 | 361 | 0.50 | turbulent-transition |
| 17 | 120 | 5 | 1028 | 433.2 | 0.50 | turbulent |
| 18 | 95 | 5 | 1028 | 505.4 | 0.50 | turbulent |

TABLE 2-continued

Microcapillary strips for obtaining 20 $m^3$/hr air flow from flexible bag

| | CAPILLARY PARAMETERS | | | | | |
|---|---|---|---|---|---|---|
| Microcapillary strip sample # | Number of channels to get ~20 $m^3$/hr air flow | Length mm | Oval width um | Oval height um | Pressure applied to bag psig | Flow Regime |
| 19 | 80 | 5 | 1028 | 577.6 | 0.50 | turbulent |
| 20 | 110 | 5 | 1028 | 361 | 1.00 | turbulent |
| 21 | 80 | 5 | 1028 | 433.2 | 1.00 | turbulent |
| 22 | 65 | 5 | 1028 | 505.4 | 1.00 | turbulent |
| 23 | 55 | 5 | 1028 | 577.6 | 1.00 | turbulent |

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A flexible bag comprising:

opposing flexible films composed of a polymeric material, the flexible films defining a common peripheral edge;

a microcapillary strip located between the opposing flexible films and extending along a portion of the common peripheral edge, the microcapillary strip comprising two or more channels disposed in a matrix, the channels extending parallel with respect to each other from a first end to an opposing second end of the microcapillary strip, each channel having a diameter from 50 μm to 1,000 μm, the microcapillary strip having a length extending from the first end to the opposing second end from 0.1 cm to 10.0 cm;

a peripheral seal extending along at least a portion of the common peripheral edge, the peripheral seal sealing the microcapillary strip between the opposing flexible films;

the peripheral seal forming a closed compartment; and an amount of a flowable solid particulate material (FSPM) in the closed compartment.

2. The flexible bag of claim 1 wherein the flexible bag is a heavy duty flexible bag with from 4.5 kg to 45 kg of the FSPM in the closed compartment.

3. The flexible bag of claim 1 wherein the particles of the flowable solid particulate material have a D50 from 1 μm to 1000 μm.

4. The flexible bag of claim 1 wherein each flexible film is a monolayer film comprising a blend of linear low density polyethylene and low density polyethylene.

5. The flexible bag of claim 1 wherein the matrix of the microcapillary strip is composed of a blend of high density polyethylene and low density polyethylene.

6. The flexible bag of claim 1 wherein a perforated film covers at least one of the first end and the opposing second end of the microcapillary strip.

7. The flexible bag of claim 6 wherein a first portion of the perforated film extends over a first surface of the microcapillary strip; and the first portion of the perforated film is sealed between the flexible film and the first surface of the microcapillary strip.

8. The flexible bag of claim 7 wherein a second portion of the perforated film extends over a second surface of the microcapillary strip; and the second portion of the perforated film is sealed between the flexible film and the second surface of the microcapillary strip.

9. The flexible bag of claim 6 wherein the perforated film comprises a plurality of perforations disposed in a spaced-apart manner on the perforated film, each perforation having a diameter from 0.5 μm to 200 μm; and some of the perforations are in fluid communication with the channels of the microcapillary strip.

10. The flexible bag of claim 9 wherein the FSPM has a D50 particle size and the perforations have a diameter that is less than the D50 particle size of the FSPM.

11. The flexible bag of claim 1 wherein the matrix comprises a hydrophobic material.

12. The flexible bag of claim 11 wherein the channels provide a pathway through which residual air is evacuated from the closed compartment, and the microcapillary strip prevents external moisture from entering into the closed compartment.

13. The flexible bag of claim 12 wherein an air flow through the channels is 20 $m^3$/hr when a pressure of 0.5 psig is applied to the flexible bag.

14. The flexible bag of claim 12 wherein an air flow through the channels is 20 $m^3$/hr when a pressure of 1.0 psig is applied to the flexible bag.

15. A flexible bag comprising:

opposing flexible films composed of a polymeric material, the flexible films defining a common peripheral edge;

a microcapillary strip located between the opposing flexible films and extending along a portion of the common peripheral edge, the microcapillary strip comprising two or more channels disposed in a matrix, the channels extending parallel with respect to each other from a first end to an opposing second end of the microcapillary strip, each channel having a diameter from 50 μm to 1,000 μm, the microcapillary strip having a length extending from the first end to the opposing second end from 0.1 cm to 10.0 cm;

a peripheral seal extending along at least a portion of the common peripheral edge, the peripheral seal sealing the microcapillary strip between the opposing flexible films;

the peripheral seal forming a closed compartment; and an amount of a flowable solid particulate material (FSPM) in the closed compartment, the FSPM comprising particles having a D50 from 1 μm to 1000 μm, wherein the channels provide a pathway through which residual air can be evacuated from the closed compartment, and the microcapillary strip prevents external moisture from entering into the closed compartment.

16. The flexible bag of claim 15 wherein an air flow through the channels is 20 $m^3$/hr when a pressure of 0.5 psig is applied to the flexible bag.

17. The flexible bag of claim 16 wherein a perforated film covers at least one of the first end and the opposing second end of the microcapillary strip;

the perforated film comprises a plurality of perforations disposed in a spaced-apart manner on the perforated film, each perforation having a diameter that is less than the D50 particle size of the FSPM; and some of the perforations are in fluid communication with the channels of the microcapillary strip.

18. The flexible bag of claim 16 wherein each channel has a diameter from 200 μm to 1,000 μm, and the FSPM has a D50 from 1 μm to 600 μm.

19. The flexible bag of claim 15 wherein an air flow through the channels is 20 $m^3$/hr when a pressure of 1.0 psig is applied to the flexible bag.

* * * * *